US006994059B2

(12) United States Patent
Greppmair

(10) Patent No.: US 6,994,059 B2
(45) Date of Patent: Feb. 7, 2006

(54) INTERNAL COMBUSTION ENGINE-DRIVEN WORKING MACHINE PROVIDED WITH OIL LUBRICATION

(75) Inventor: Martin Greppmair, München (DE)

(73) Assignee: Wacker Construction Equipment AG, Munich (DE)

( * ) Notice: Subject to any disclaimer, the term of this patent is extended or adjusted under 35 U.S.C. 154(b) by 180 days.

(21) Appl. No.: 10/469,377

(22) PCT Filed: Mar. 1, 2002

(86) PCT No.: PCT/EP02/02257

§ 371 (c)(1),
(2), (4) Date: Aug. 27, 2003

(87) PCT Pub. No.: WO02/070868

PCT Pub. Date: Sep. 12, 2002

(65) Prior Publication Data

US 2004/0079305 A1 Apr. 29, 2004

(51) Int. Cl.
*F02B 33/04* (2006.01)

(52) U.S. Cl. ..... 123/73 AD; 123/198 E

(58) Field of Classification Search ..... 123/73 AD, 123/195 C, 196 R, 196 M, 198 E, 198 P
See application file for complete search history.

(56) References Cited

U.S. PATENT DOCUMENTS

| | | | |
|---|---|---|---|
| 3,286,790 | A | 11/1966 | Kestel |
| 3,642,077 | A | 2/1972 | Bayard |
| 4,726,330 | A | 2/1988 | Shiga |
| 6,161,510 | A | 12/2000 | Ishikawa et al. |

FOREIGN PATENT DOCUMENTS

| | | |
|---|---|---|
| DE | 1 031 738 | 6/1958 |
| DE | 1 208 234 | 12/1965 |
| DE | 2 121 064 | 11/1972 |
| FR | 2 332 107 | 11/1976 |

*Primary Examiner*—Noah P. Kamen
(74) *Attorney, Agent, or Firm*—Boyle Fredrickson Newholm Stein & Gratz S.C.

(57) ABSTRACT

A working machine, particularly an internal combustion engine-driven tamper for compacting soil comprises a tamping system, which is driven by the internal combustion engine and which is provided with an oil lubrication. The enclosure surrounding the tamping system comprises a small opening, which is situated downstream from an air filter and which leads into an air induction channel of the internal combustion engine. The cross-section of the opening is dimensioned so that it enables an equalization of pressure between the tamping system and the surrounding area and allows oil to travel from the tamping system and into the air induction channel of the engine. Oil for lubricating can be supplied to the engine via the opening. The opening is also suited for equalizing pressure which is particularly necessary when the tamping system and its enclosure heat up.

12 Claims, 2 Drawing Sheets

INTERNAL COMBUSTION ENGINE-DRIVEN WORKING MACHINE PROVIDED WITH OIL LUBRICATION

BACKGROUND OF THE INVENTION

1. Field of the Invention

The invention relates to a working machine, in particular a tamper for ground-compaction purposes which is driven by means of an internal combustion engine, according to the preamble of claim 1.

2. Description of the Related Art

Tampers of this type are conventionally constructed in such a manner that an upper mass which accommodates a motor and a crank drive is connected by way of a spring set to a working mass which substantially forms a tamping plate. The crank drive converts the rotational movement, which is generated by the motor, into an oscillating linear movement, for which reason a guide piston is guided in such a manner as to be able to move longitudinally in a guide tube. The system which is located between the motor outlet and the tamping plate is defined hereinunder as the tamping system. In the case of modem tampers, the tamping system is provided with oil lubrication. In order to prevent oil from issuing out of the tamping system but also to prevent the penetration of dirt into the tamping system, the tamping system in the case of known tampers is surrounded by an enclosure which can consist, for example, of a combination of rigid housing parts and expansion bellows. To date, the enclosure has been designed in such a manner that it effects a complete seal of the tamping system which means that it is not possible to achieve pressure equalisation between the sealed interior and the atmosphere.

In the case of working machines of this type, for the purpose of lubricating the drive motor, i.e. the cylinder, the piston and the piston rings, as well as the bearings and the shaft sealing rings, it is conventional to provide a petroil lubrication, i.e. the operation with a fuel-oil mixture which is stored in liquid form in the tank. In order to configure the operation of these machines in the most convenient manner possible and with the lowest possible maintenance, the development is moving towards providing a separate lubrication, wherein the oil required to lubricate the motor is taken from the oil supply contained in the closed tamping system. Tests have shown that it is possible at this site to accommodate a sufficiently large quantity of oil without impairing the performance of the tamper. The desired switch to separate lubrication has hitherto been delayed because it has been assumed that to accomplish this it would be necessary to implement relatively large structural modifications on the machines introduced at that time, such as delivery devices for transporting the oil from the tamping system to the motor.

OBJECTS AND SUMMARY OF THE INVENTION

Therefore, it is the object of the invention to provide a separate lubrication for the drive motor of tampers which can be accomplished with a small amount of outlay and in particular without substantially affecting the existing design and can be adapted in a convenient manner to suit the lubricant requirement of the motor.

In accordance with the invention the object is achieved according to the characterising feature of claim 1 in that the enclosure which encompasses the tamping system is provided with a small opening which opens out downstream of the air filter into the air induction channel of the internal combustion engine and whose cross-section is precisely dimensioned so as to enable the equalisation of pressure between the tamping system and the surrounding area and to allow oil to travel from the tamping/percussion system into the air induction channel of the motor.

This also solves a further problem of modern tampers which is caused by the lack of pressure equalisation between the sealed interior of the enclosure and the atmosphere. Pressure equalisation has hitherto not been provided so as not to impair the protective function of the enclosure. However, it has been shown that this does not give rise to negligible disadvantages. The tamping system is conventionally mounted in such a manner that the crank assumes the upper dead centre position, i.e. that the machine assumes its minimum structural height, in which the upper mass is maximally approximated to the working mass, or the upper mass assumes its lowest position relative to the working mass. By rotating the crank drive, the tamper is extended, i.e. the upper mass is raised relatively to the working mass until finally in the lower dead centre position of the crank drive, the tamper has reached its maximum structural height. For example, the tamper stroke amounts to 60 mm. In order to be able to accommodate this relative movement between the upper mass and the working mass, the aforementioned expansion bellows are provided. During the movement between the upper and the lower dead centre position of the crank drive, the volume (enclosed volume) which is encompassed by the enclosure increases and consequently negative pressure is generated in the encompassed region.

This negative pressure not only makes it more difficult to start the machine running during start-up, which can cause the motor to die and, for example, can cause increased clutch wear, but the seals and the expansion bellows are also loaded by the negative pressure which occurs.

Various factors which cannot be influenced significantly without substantial outlay cause the temperature of the working machine to increase considerably, namely as a result of exposure to sunlight, frictional heat on the longitudinal guide arrangement of the tamper, internal friction of the springs of the tamping system, friction of the bearings and shaft seals, and radiation heat from the motor flange-mounting and heating caused by the heated cooling air of the motor which blows on to the crank casing. This significant increase in temperature is additionally intensified by the heat losses from the compaction work resulting from the continuously changing stroke volume. Pressure differences which occur in the closed system also have an effect, if there is a relatively large difference in amplitude between the site where the tamper is assembled and the site where it is used.

The accumulated heat and the resulting build-up in pressure are often the reason why the tamper—in particular in the case of pre-compacted ground surfaces—operates noisily and erratically.

This is also achieved by the inventive solution. The opening which serves as the pressure equalisation opening avoids the unnecessary compaction work and at the same time with each stroke of the tamping system an amount of oil which is swirled by this tamping system travels into the air induction channel and upon further swirling in the carburettor it then travels further to the motor. Since the pressure equalisation opening opens up downstream of the induction air filter into the air induction channel, i.e. on the clean side of the air filter, it is not possible for any particles of dirt to pass into the interior of the enclosure to the tamping system whilst air is inducted through the pressure equalisation opening for the purpose of obviating the negative pressure. On the other hand, when air is passed through the pressure equalisation opening in the opposite direction, which causes an oil mist to issue out into the air induction channel, the filter seal is not expected to be wetted with oil to any significant extent.

Since the tamping system is capable not only of accommodating the amount of oil required for lubrication thereof during a service interval but also of accommodating the amount of oil required to lubricate the motor to a maximum of between two services, it is possible without complicated structural modifications for the tamper to be operated in a completely maintenance-free manner between the prescribed services. In particular, there is no need to top up the mixture or to add to the oil supply during the service intervals. Finally, the pressure equalisation also eliminates the cause of the hitherto frequently observed phenomenon that after the work is finished and the tamper heats up as a result, the increased internal pressure in the closed tamper system means that the tamper is no longer able to return to its starting position, in which it assumes its lowest structural height.

Tests have shown that an opening diameter of 0.8 mm allows sufficient air to be supplied to and vented from the tamping system and moreover a discharge of oil can be established which should be sufficient to lubricate the motor. Should a greater amount of oil be required, the cross-section of the pressure equalisation opening can be adapted accordingly, as in accordance with one advantageous embodiment the pressure equalisation opening is formed in an interchangeable nozzle body. This can be, for example, a marketable carburettor nozzle.

Preferably, the pressure equalisation opening issues upstream of a Venturi-section of the carburettor, which is allocated to the motor, into the air induction channel, so that the oil mist is subjected at this site to further intimate swirling with the combustion air and the fuel.

In order to ensure that the motor is supplied with the best possible oil quality, in accordance with a further advantageous embodiment of the invention, components of the tamping or percussion system which are subjected to abrasive wear consist of materials having effective sliding properties and low abrasion.

BRIEF DESCRIPTION OF THE DRAWINGS

The invention will be explained in detail with reference to the description hereinunder of an exemplified embodiment of the invention as illustrated in the drawing, in which.

DETAILED DESCRIPTION OF THE PREFERRED EMBODIMENTS

Figure 1:
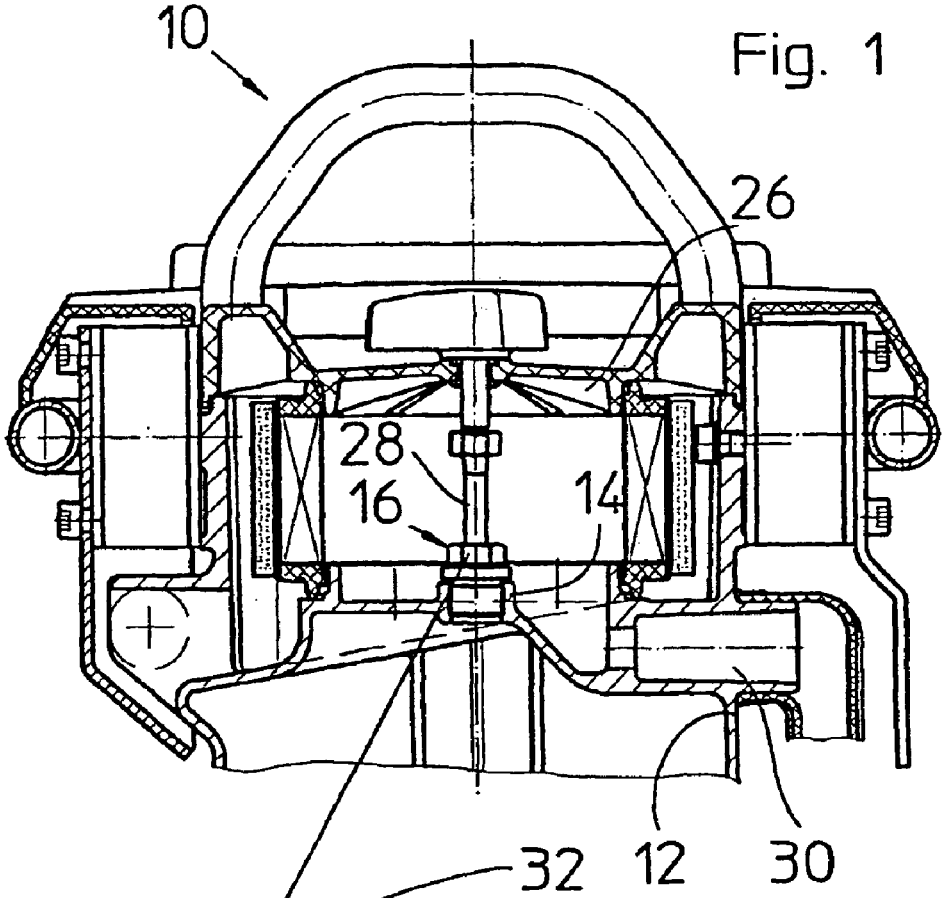
FIG. 1 shows a sectional view of a portion of the upper mass of a tamper for ground-compaction, having an air filter and an air induction channel which leads from the air filter to the drive motor [not illustrated]

The upper mass, which is designated overall by the reference numeral 10 and is only partially illustrated, of a tamper for ground-compaction purposes which can be driven by a 2-cycle internal combustion engine [not illustrated] demonstrates a housing portion 12 which is part of an enclosure of the tamping system. This housing portion 12 is provided with a threaded bore which passes through a lug 14 and into which a nozzle body 16 is screwed. For this purpose, the nozzle body 16 is provided with a threaded end 18 which is adjoined by a collar 20 which covers the threaded bore. Integrally formed on the side of the collar 20 remote from the threaded end 18 is a hexagon 22 which is used for tightening the nozzle body 16 in the threaded bore. A threaded bore 24 which serves to attach an air filter 26 by means of an attachment pin 28 which passes centrally through the air filter 26 opens up at the end side of the hexagon 22. The induction air which passes through the air filter 26 and is intended for the internal combustion engine [not illustrated] flows into the internal combustion engine through an air induction channel 30 which is formed on the housing portion 12.

Figure 2:
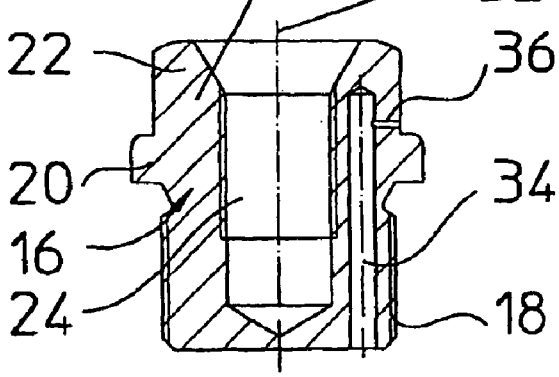
FIG. 2 shows an enlarged scale sectional view of a nozzle body having an angle-bent pressure equalisation opening and an attachment thread for an air filter.

As shown in FIG. 2, the nozzle body 16 contains an eccentric blind bore 34 which is in parallel with the thread axis 32 thereof and which issues out of the threaded end 18 and thus is connected to the space which is encompassed by the enclosure 12 and is provided for receiving the tamping system [not illustrated], if the nozzle body 16 assumes its position shown in FIG. 1. A radially extending fine bore 36 which issues out above the collar 20 serves to establish a connection between the blind bore 34 and the air induction channel 30. The bore 36 is the pressure equalisation opening which serves as an opening.

Therefore, a connection exists continuously between the internal space of the enclosure 12 containing the tamping system and the atmosphere surrounding the tamper, so that pressure can be equalised at any time. If the cross-section of the pressure equalisation opening 36 is to be changed, the air filter 26 is first removed so that the nozzle body 16 can be readily exchanged for a different nozzle body, of which the bore 36 comprises a different cross-section.

Figure 3:
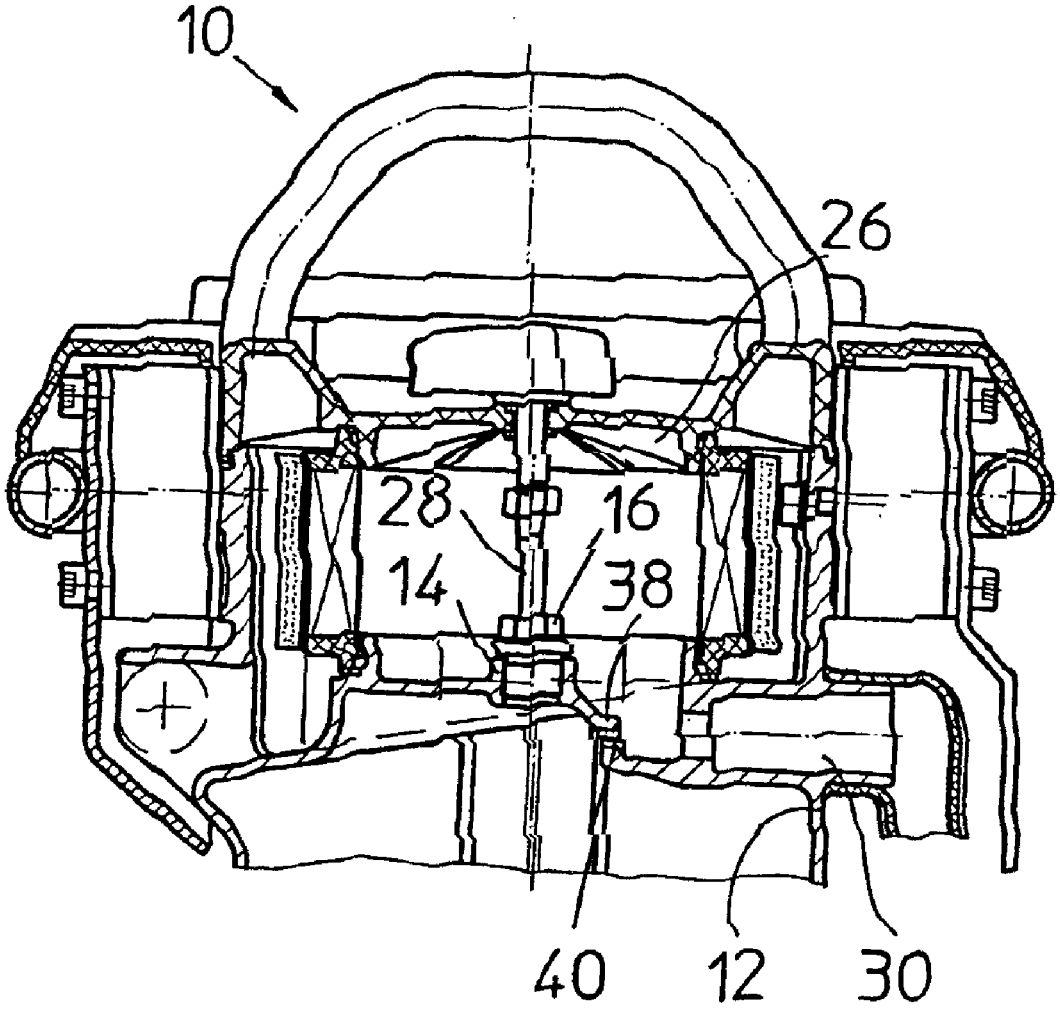
FIG. 3 shows an illustration, similar to FIG. 1, of a preferred embodiment of the invention.

FIG. 3 shows a structural variation which in contrast to the construction as shown in FIG. 2 requires a slight modification on the housing portion 12 in the region of the air induction channel 30, namely an additionally cast-on lug 38, into which a threaded bore can be worked which serves to receive an interchangeable nozzle 40. This renders it possible to improve the outflow ratios at the nozzle 40 in order to prevent the air filter from becoming contaminated by oil issuing into the air induction channel 30. Where the variability of the nozzle opening is sacrificed, it is the lug 38 and not the threaded bore which can also be provided with a simple opening having a suitable cross-section for the purpose of supplying and venting air.

What is claimed is:

1. A tamper for ground-compaction in which the drive motor for the tamper is an internal combustion engine, the tamper comprising: a working mass which can be driven linearly in a reciprocating manner by means of the drive motor for the purpose of exerting a tamping or percussive action, and having a tamping or percussion system which is surrounded by an enclosure and in which the rotational movement of the drive motor is converted into a reciprocating linear movement and is transmitted to the working mass, wherein the tamping or percussion system is provided with oil lubrication and the air induction channel of the motor is provided with an air filter, wherein the enclosure which surrounds the tamping or percussion system is provided with a small opening which opens out downstream of the air filter into the air induction channel of the internal combustion engine and whose cross-section is dimensioned so as to enable the equalization of pressure between the tamping or percussion system and a surrounding area and to allow oil to travel from the tamping or percussion system into the air induction channel of the motor.

2. A working machine as claimed in claim 1, wherein the opening is a bore having a diameter of at least 0.8 mm.

3. A working machine as claimed in claim 1, wherein the opening opens out upstream of a Venturi-section of a carburetor, which is allocated to the motor, into the air induction channel.

4. A working machine as claimed in claim 1, wherein the opening is formed in an interchangeable nozzle body.

5. A working machine as claimed in claim 4, wherein the opening is formed by the nozzle bore of a carburetor nozzle which is inserted into the enclosure in such a manner as to be interchangeable.

6. A working machine as claimed in claim 1, wherein the components of the tamping or percussion system which are subjected to abrasive wear consist of materials having effective sliding properties and low abrasion.

7. A tamper for ground-compaction comprising:

an internal combustion engine having an air induction channel and an air filter located in the air induction channel;

a working mass which is driven by the engine to linearly reciprocate;

an enclosure;

an oil lubricated tamping or percussion system which is surrounded by the enclosure and in which rotational movement of the engine is converted into a reciprocating linear movement and is transmitted to the working mass, wherein the enclosure is provided with an opening which opens into the air induction channel of the engine downstream of the air filter, and wherein the opening has a cross-section that is dimensioned so as to enable the equalization of pressure between the tamping or percussion system and a surrounding area and to allow oil to travel from the tamping or percussion system into the air induction channel of the engine.

8. A working machine as claimed in claim 7, wherein the opening is a bore having a diameter of at least 0.8 mm.

9. A working machine as claimed in claim 7, wherein the engine has a carburetor and the opening opens into the air induction channel upstream of a Venturi-section of the carburetor.

10. A working machine as claimed in claim 7, wherein the opening is formed in an interchangeable nozzle body.

11. A working machine as claimed in claim 10, wherein the opening is formed by a nozzle bore of an interchangeable carburetor nozzle which is inserted into the enclosure.

12. A working machine as claimed in claim 7, wherein components of the tamping or percussion system which are subjected to abrasive wear are formed from materials having effective sliding properties and low abrasion.

* * * * *